United States Patent [19]

Matsushita et al.

[11] 4,446,833

[45] May 8, 1984

[54] FUEL INJECTION APPARATUS FOR AN INTERNAL COMBUSTION ENGINE

[75] Inventors: Yukio Matsushita, Iwata; Toshikatsu Nozaki, Shizuoka, both of Japan

[73] Assignees: Yamaha Hatsudoki Kabushiki Kaisha; Sanshin Kogyo Kabushiki Saisha, both of Japan

[21] Appl. No.: 446,726

[22] Filed: Dec. 3, 1982

[30] Foreign Application Priority Data

Dec. 7, 1981 [JP] Japan ..... 56-195668

[51] Int. Cl.[3] ..... F02M 7/00; F02M 51/00; F02B 33/04

[52] U.S. Cl. ..... 123/435; 123/73 R; 123/73 A; 123/73 C; 123/478; 123/494

[58] Field of Search ..... 123/435, 478, 494, 73 R, 123/73 A, 73 C

[56] References Cited

U.S. PATENT DOCUMENTS

| | | | |
|---|---|---|---|
| 1,653,877 | 12/1927 | Schaff | 123/435 |
| 2,507,988 | 5/1950 | MacMillan | 123/435 |
| 2,592,284 | 4/1952 | Hopkins | 123/435 |
| 3,751,921 | 8/1973 | Blomberg et al. | 123/73 R |
| 4,200,063 | 4/1980 | Bowler | 123/478 |
| 4,290,394 | 9/1981 | Frank et al. | 123/73 R |
| 4,305,351 | 12/1981 | Staerzl | 123/73 R |
| 4,327,688 | 5/1982 | Lowther | 123/435 |
| 4,351,281 | 9/1982 | Geiger et al. | 123/435 |
| 4,381,662 | 5/1983 | Jiewertz | 123/435 |

FOREIGN PATENT DOCUMENTS

| | | | |
|---|---|---|---|
| 44-8532 | 4/1969 | Japan | 123/73 R |
| 47-38332 | 9/1972 | Japan | 123/73 R |

*Primary Examiner*—Wendell E. Burns
*Attorney, Agent, or Firm*—Ernest A. Beutler

[57] ABSTRACT

A fuel injection control method and system for a crankcase compression two cycle engine wherein the amount of fuel discharge is controlled by the pressure in the crankcase.

36 Claims, 2 Drawing Figures

FUEL INJECTION APPARATUS FOR AN INTERNAL COMBUSTION ENGINE

BACKGROUND OF THE INVENTION

This invention relates to a fuel injection apparatus for an internal combustion engine and more particularly to an improved control arrangement for a fuel injection system.

In fuel injected engines, it is, of course, extremely important to accurately control the quantity of fuel injected in accordance with the air inducted in order to achieve the optimum fuel/air ratio for a given operating condition of the engine. Various devices have been proposed for measuring the air flow in an induction system of an engine to control the amount of fuel injected. Conventionally, such air flow measuring devices have been large and complicated and have been positioned in the induction system, normally upstream of the point of discharge of the fuel. In one type of flow detector, a flap type arrangement is provided in the intake passage and has a member that swings open to an amount that is determined by the air flow. The angular position of this detector is then measured and used to provide an air flow signal for the fuel injection system. Alternatively, vortex type air flow meters have been positioned in the induction system for determining air flow. Still another type of measuring device employs a hot wire anemometer which provides an electrical resistance wire interposed in the air stream to have its resistance vary in relation to the speed, i.e., cooling effect, of the air flowing through the induction system. The use of such flow meters in the induction system has several disadvantages.

In the first instance, the provision of an air flow measuring device in the induction system can oftentimes reduce the volumetric efficiency of the induction system. Furthermore, such devices substantially increase the size of the induction system. Also, devices of the type aforenoted are not particularly efficient with engines having a low number of cylinders or specifically with single cylinder engines due to the pulsations in the intake flow. Although such pulsations may be reduced to some extent through the use of a plenum chamber, this adds still further to the size of the induction system. Furthermore, if the flow meter is used in conjunction with the internal combustion engine of an outboard motor or other marine application, there is a high likelihood of corrosion in the moving components of the flow meter due to the salt in the atmosphere.

It is, therefore, a principal object of this invention to provide an improved fuel flow control device for the fuel injection system of an internal combustion engine.

It is another object of this invention to provide an improved air flow detecting device for controlling the fuel injection system of an engine.

It is yet another object of this invention to provide a fuel control device for a fuel injection system of an internal combustion engine that accurately controls fuel flow in response to the amount of air flowing through the intake system.

It is a yet further object of this invention to provide a fuel control for a fuel injection system that does not rely upon a device that is interposed in the air induction system.

SUMMARY OF THE INVENTION

A first feature of the invention is adapted to be embodied in a fuel injection control system for an internal combustion engine comprising a chamber in which an intake charge is compressed during engine operation and fuel injection means for delivering fuel to an air charge. In accordance with this feature of the invention, means control the fuel delivered by the fuel injection means in response to the pressure in the chamber.

Another feature of this invention is also adapted to be embodied in a fuel injection control system for an internal combustion engine. Such an engine has a variable volume chamber, an induction system for delivering a charge to the chamber and a fuel injection means for delivering fuel. In accordance with this feature of the invention, means control the fuel delivered by the fuel injection means in response to a pressure that varies during a single cycle of engine operation.

Another feature of this invention is adapted to be embodied in a fuel injection control system for an internal combustion engine as defined in the preceding paragraph. In accordance with this feature of the invention, the fuel injection means delivers fuel to the induction system upstream of the point of discharge of the induction system into the chamber. In accordance with this feature of the invention, means control the fuel delivered by the fuel injection means in response to a pressure downstream of the point of injection into the induction system.

Another feature of the invention is adapted to be embodied in a method for controlling the fuel discharge of a fuel injection control system for an internal combustion engine having a chamber in which the intake charge is compressed during engine operation. In accordance with this method, the pressure in the chamber is measured and the amount of fuel discharged by a fuel injection system is controlled in response to this pressure.

Yet another feature of the invention is also adapted to be embodied in a method for controlling the fuel of a fuel injection system in connection with an engine that has a variable volume chamber, an induction system for delivering a charge to the chamber and fuel injection means for delivering fuel. In accordance with this method, the variable pressure in the chamber during a single cycle of engine operation is measured and the amount of fuel delivered by the injection system is controlled in response to this pressure.

Yet another feature of the invention is also adapted to be embodied in a method for controlling the fuel discharge of a fuel injection system of an engine as described in the preceding paragraph. In accordance with this method, the fuel is delivered to the induction system by the injection means upstream of the point of discharge of the induction system into the engine chamber. A pressure in the engine is measured downstream of the point of fuel injection and the amount of fuel injected is controlled in response to this pressure.

DETAILED DESCRIPTION OF THE PREFERRED EMBODIMENTS

Turning first to the theory on which the invention is based, it is known that the pressure in a variable volume chamber of an internal combustion engine varies cyclically during the engine operation and that the peak pressure is related to the amount of air inducted. This is particularly true in conjunction with crankcase compression two cycle engines wherein the pressure in the crankcase increases proportionally to an increase in the amount of air inducted, assuming other conditions to be the same. In accordance with the invention, the amount of fuel injected is controlled in relation to this pressure so as to provide an accurate fuel/air ratio without necessitating the use of an air flow meter in the engine induction system.

Figure 1:
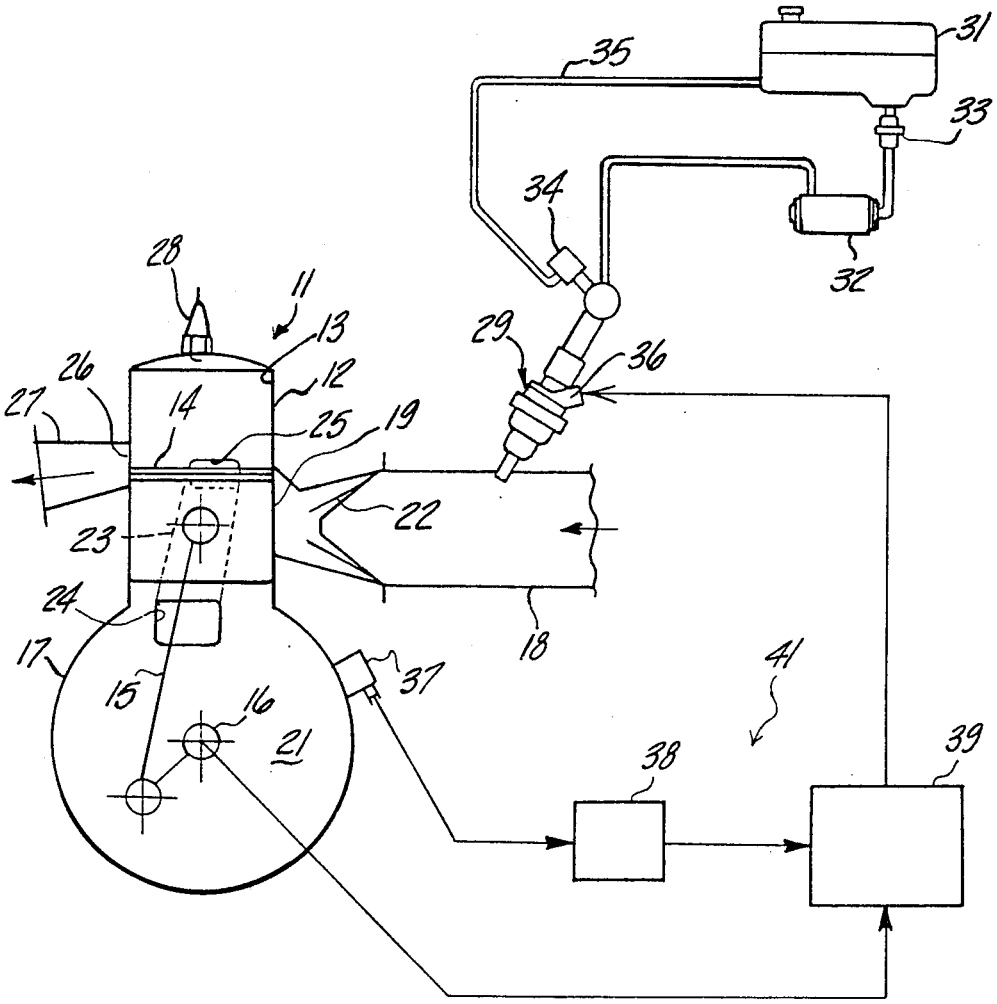
FIG. 1 is a partially schematic view of an internal combustion engine constructed in accordance with an embodiment of the invention and operating according to an embodiment of the invention.

Referring now specifically to FIG. 1, a single cylinder two cycle, crankcase compression, internal combustion engine constructed in accordance with an embodiment of the invention is shown in part in cross-section and in part schematically and is identified generally by the reference numeral 11. The engine 11 includes a cylinder block 12 having a cylinder bore 13 in which a piston 14 is supported for reciprocation in a known manner. The piston 14 is connected by means of a connecting rod 15 to a crankshaft 16 that is rotatably journalled in a known manner in a crankcase 17 of the engine.

The engine 11 includes an intake system that comprises an air intake pipe 18 that terminates in an intake port 19 that sequentially communicates with a sealed volume 21 within the crankcase 17 when the piston 14 is above a certain predetermined position above its bottom dead center position. A reed type check valve 22 is positioned in the induction passage 18 so as to prevent undesirable reverse flow from the crankcase cavity 21 back into the induction system 18.

A transfer or scavenge passage 23 extends through the cylinder block 12 and terminates at an inlet opening 24 in the crankcase cavity 21. The upper end of the scavenge or transfer passage 23 terminates in an inlet scavenge port 25 formed in the cylinder wall 13 at a point above the bottom dead center position of the piston 14.

An exhaust port 26 is also formed in the cylinder bore 13 and communicates with an exhaust passage 27 for the discharge of exhaust gases to the atmosphere. The exhaust port 26 is position above the bottom dead center position of the piston 14 and is slightly higher in the cylinder bore 13 than the transfer or scavenge port 25.

A spark plug 28 is provided in the cylinder head of the engine for firing a charge.

The engine 11 is provided with a fuel injection system that includes an injection nozzle 29 that discharges into the intake pipe 18 upstream of the reed type check valve 22. Fuel is supplied to the nozzle 29 from a fuel tank 31 by means of an appropriate fuel pump 32. A fuel filter or strainer 33 is interposed in the conduit connecting the fuel tank 31 with the pump 32. A pressure control valve 34 is provided in the supply line to the fuel injection nozzle 29 and has a return line 35 that extends back to the fuel tank 31. The valve 34 insures that a substantially constant pressure of fuel is delivered to the injection nozzle 29.

The injection nozzle 29 includes an electro-magnetic controller 36 that functions in a known manner so as to control the amount of fuel discharged by the nozzle 29 into the intake pipe 18.

During running of the engine, an intake air charge is delivered to the intake pipe 18 and fuel is injected by the nozzle 29 to provide a fuel/air mixture which is admitted to the crankcase chamber 21 when the piston 14 has moved upwardly so as to uncover the intake port 19. The reed valve 22 will be opened under this condition so long as the pressure upstream of it exceeds the pressure on its downstream side. At the same time the piston 14 is moving upwardly to induct an air/fuel charge into the crankcase chamber 21, the spent combustion products will be discharged through the exhaust port 26 and exhaust passage 27. Furthermore, the charge which has been previously transferred from the crankcase chamber 21 to the upper side of the piston 14 through the transfer or scavenge passage 23, which charge has been compressed, will be delivered to the spark plug 24 for firing as is typical with engines operating on the two stroke principle.

As has been previously noted, it is important to control the electro-magnetic portion 36 of the fuel injection nozzle 29 so as to provide an appropriate fuel/air ratio under all running characteristics. Previously, this has been done by providing some form of air flow sensor in the induction system and normally upstream of the point of injection of the nozzle 29. The disadvantages of such an arrangement have been described before and briefly summarized they are that such arrangements add unnecessarily to the size of the induction system, may cause reduced air flow and loss of power and further are not truly practical in connection with single cylinder engines.

In accordance with this invention, a pressure sensing device, shown schematically and identified by the reference numeral 37, is provided in the crankcase 17 for sensing the pressure (P) in the crankcase chamber 21. As has been noted, the peak pressure in the crankcase 21 of two cycle engines has been found to be directly related to the amount of air inducted when all other conditions are maintained constant. The pressure sensing device 37 may be of any known type and provides a signal, which is representative of pressure either in the form of a voltage signal or the like, to a conversion circuit, shown schematically and indicated generally by the reference numeral 38.

Figure 2:
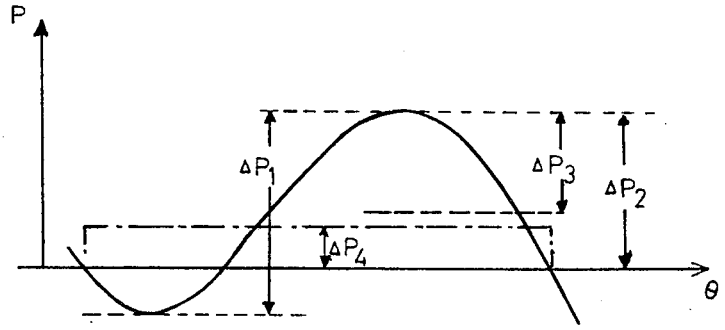
FIG. 2 is a curve illustrating the theory of the invention and several embodiments.

Referring to FIG. 2, a curve is shown that represents the pressure in the crankcase chamber 21 during each cycle of rotation of the crankshaft 16. The pressure is indicated on the ordinate while crankshaft angle ($\theta$) is indicated on the abscissa. It should be noted that the pressure varies from a minimum pressure that is subatmospheric during the upward motion of the piston 14 to a maximum pressure which is, of course, positive when the piston 14 is moving downwardly toward its bottom dead center position The maximum pressure will normally occur at some point close to bottom dead center.

The conversion circuit 38 mav be designed to provide a pressure signal that is related to either the difference between the maximum and minimum pressures in the crankcase chamber 21 ($\Delta P_1$), the maximum pressure in the chamber 21 above atmospheric ($\Delta P_2$), the amount of pressure in excess of a predetermined constant pressure $P_x$ ($\Delta P_3$) or the time area average of the curve within one cycle of operation of the engine ($\Delta P_4$). The actual signal employed may depend upon characteristics to be chosen and an optimum for a given engine and configuration can be selected. The signal V(ΔP) is transmitted to an appropriate control device 39 which may be in the form of a computer circuit. This circuit receives the pressure signal from the conversion circuit 38 and a signal that is responsive to the angle of rotation of the crankshaft 16 ($\theta$) so as to provide an injection signal (I) to the electro-magnetic controller 36 so as to control both the timing and amount of fuel discharged by the nozzle 29.

In addition to the pressure (ΔP) signal transmitted to the computer 39 and the crankcase angle signal ($\theta$), various other inputs such as air temperature, engine temperature, acceleration, deceleration or other operating conditions can be preprogrammed into the unit 39 so as to provide an appropriate control for the fuel discharge so as to achieve the desired fuel/air ratios throughout the engine running conditions. Of course, a particular program can be stored into the computer 39 to arrive at this calculation and such units are well within the scope of those skilled in the art.

The fuel control circuit is identified generally by the reference numeral 41 and may be of either the digital or analog type. In addition to controlling the discharge of the fuel injection nozzle 29, the circuit 41 can control a lubricant which may be either mixed with the fuel or supplied separately.

Although the invention has been described in conjunction with an electronic control for the fuel injection, it should be readily apparent that the invention is equally applicable to mechanically controlled systems. For example, it is possible to employ a mechanical system having a 3-dimensional cam wherein the cam is moved in response to a pressure signal from the sensing device 37. In all events, however, the control of the fuel supply is achieved in direct proportion to air flow without the necessity of the provision of a bulky air flow detector in the induction system 18 upstream of the injection nozzle 29. In addition to achieving a size benefit, the disclosed system and method dispenses with the provision of mechanical components in the induction system which may be subject to corrosion and other defects. Furthermore, the dynamic control achieved by this device permits use with single cylinder engines.

Although some embodiments of the invention have been described, it should be readily apparent to those skilled in the art that various changes and modifications may be made without departing from the spirit and scope of the invention, as defined by the appended claims.

We claim:

1. In a fuel injection control system for an internal combustion engine comprising a chamber in which an intake charge is compressed during engine operation and fuel injection means for delivering fuel to an air charge, the improvement comprising means for controlling the amount of fuel delivered by said fuel injection means in response to the pressure in said chamber.

2. In a fuel injection control system as claimed in claim 1 wherein the controlling means is responsive to the maximum pressure in the chamber during a given cycle of operation.

3. In a fuel injection control system as claimed in claim 1 wherein the controlling means is responsive to the difference between the maximum pressure and the minimum pressure in the chamber during a given cycle of operation.

4. In a fuel injection control system as claimed in claim 1 wherein the controlling means is responsive to the excess pressure over atmospheric in the chamber during a given cycle of operation.

5. In a fuel injection control system as claimed in claim 1 wherein the controlling means is responsive to the area under a curve of pressure versus time of cycle of operation of the engine.

6. In a fuel injection control system as claimed in claim 1 wherein the chamber has a fuel/air charge in it and the pressure is the pressure of the fuel/air charge.

7. In a fuel injection control system as claimed in claim 6 wherein the controlling means is responsive to the maximum pressure in the chamber during a given cycle of operation.

8. In a fuel injection control system as claimed in claim 6 wherein the controlling means is responsive to the difference between the maximum pressure and the minimum pressure in the chamber during a given cycle of operation.

9. In a fuel injection control system as claimed in claim 6 wherein the controlling means is responsive to the excess pressure over atmospheric in the chamber during a given cycle of operation.

10. In a fuel injection control system as claimed in claim 6 wherein the controlling means is responsive to the area under a curve of pressure versus time of cycle of operation of the engine.

11. In a fuel injection control system as claimed in claim 1 wherein the chamber is a variable volume chamber that has its volume varying from a maximum to a minimum during a cycle of operation of the engine.

12. In a fuel injection control system as claimed in claim 11 wherein the variable volume chamber is a crankcase of the engine.

13. In a fuel injection control system as claimed in claim 12 wherein the controlling means is responsive to the maximum pressure in the chamber during a given cycle of operation.

14. In a fuel injection control system as claimed in claim 12 wherein the controlling means is responsive to the difference between the maximum pressure and the minimum pressure in the chamber during a given cycle of operation.

15. In a fuel injection control system as claimed in claim 12 wherein the controlling means is responsive to the excess pressure over atmospheric in the chamber during a given cycle of operation.

16. In a fuel injection control system as claimed in claim 12 wherein the controlling means is responsive to the area under a curve of pressure versus time of cycle of operation of the engine.

17. In a fuel injection control system for an internal combustion engine having a variable volume chamber, an induction system for delivering a charge to said chamber, and a fuel injection means for delivering fuel, the improvement comprising means for controlling the amount of fuel delivered by said fuel injection means in response to a pressure that varies during a single cycle of engine operation.

18. In a fuel injection control system as set forth in claim 17 wherein the controlling means is responsive to the maximum pressure in the chamber during a given cycle of operation.

19. In a fuel injection control system as claimed in claim 17 wherein the controlling means is responsive to the difference between the maximum pressure and the minimum pressure in the chamber during a given cycle of operation.

20. In a fuel injection control system as claimed in claim 17 wherein the controlling means is responsive to the excess pressure over atmospheric in the chamber during a given cycle of operation.

21. In a fuel injection control system as claimed in claim 17 wherein the controlling means is responsive to the area under a curve of pressure versus time of cycle of operation of the engine.

22. In a fuel injection control system as claimed in claim 17 wherein the controlling means is responsive to a pressure of the intake charge at a point other than in the induction system.

23. In a fuel injection control system as claimed in claim 17 wherein the fuel injection means injects fuel into the system upstream of the point where the control means responds to the pressure.

24. In a fuel injection control system for an internal combustion engine having a variable volume chamber, an induction system for delivering a charge to said chamber, and a fuel injection means for delivering fuel to said induction system upstream of the point of discharge of said induction system into said chamber, the improvement comprising means for controlling the fuel delivered by said fuel injection means in response to a pressure downstream of the point of injection into said induction system.

25. In a fuel injection control system as claimed in claim 24 wherein the controlling means is responsive to the maximum pressure in the chamber during a given cycle of operation.

26. In a fuel injection control system as claimed in claim 24 wherein the controlling means is responsive to the difference between the maximum pressure and the minimum pressure in the chamber during a given cycle of operation.

27. In a fuel injection control system as claimed in claim 24 wherein the controlling means is responsive to the excess pressure over atmospheric in the chamber during a given cycle of operation.

28. In a fuel injection control system as claimed in claim 24 wherein the controlling means is responsive to the area under a curve of pressure versus time of cycle of operation of the engine.

29. A method of controlling a fuel injection system for an internal combustion engine comprising a chamber in which an intake charge is compressed during engine operation and fuel injection means for delivering fuel to an air charge comprising the steps of measuring the pressure in the chamber and controlling the amount of fuel delivered by the fuel injection means in response to the measured pressure.

30. A method of controlling a fuel injection system for an internal combustion engine having a variable volume chamber, an induction system for delivering a charge to the chamber, and a fuel injection means for delivering fuel comprising the steps of measuring a pressure that varies during a single cycle of engine operation and controlling the amount of fuel discharged in response to the measured pressure.

31. A method of controlling a fuel injection system for an internal combustion engine having a variable volume chamber, an induction system for delivering a charge to the chamber, and a fuel injection means for delivering fuel to the induction system upstream of the point of discharge of the induction system into the chamber comprising the steps of measuring the pressure downstream of the point of injection of the fuel injection means and controlling the amount of fuel discharged by the fuel injection means in response to the measured pressure.

32. In a fuel injection control system for an internal combustion engine comprising a variable volume chamber that has its volume varying from a maximum to a minimum during a cycle of operation of the engine and in which an intake charge is compressed during engine operation, the variable chamber is a crankcase of the engine and fuel injection means for delivering fuel to an air charge, the improvement comprising means for controlling the fuel delivered by said fuel injection means in response to the pressure in said chamber.

33. In a fuel injection control system as claimed in claim 32 wherein the controlling means is responsive to the maximum pressure in the chamber during a given cycle of operation.

34. In a fuel injection control system as claimed in claim 32 wherein the controlling means is responsive to the difference between the maximum pressure and the minimum pressure in the chamber during a given cycle of operation.

35. In a fuel injection control system as claimed in claim 32 wherein the controlling means is responsive to the excess pressure over atmospheric in the chamber during a given cycle of operation.

36. In a fuel injection control system as claimed in claim 32 wherein the controlling means is responsive to the area under a curve of pressure versus time of cycle of operation of the engine.

* * * * *